US008112931B2

(12) United States Patent
Yost et al.

(10) Patent No.: US 8,112,931 B2
(45) Date of Patent: Feb. 14, 2012

(54) SHOTGUN GAS EXCHANGER

(76) Inventors: Bill R. Yost, Creston, OH (US); Gregory S. Marcum, Rittman, OH (US)

( * ) Notice: Subject to any disclaimer, the term of this patent is extended or adjusted under 35 U.S.C. 154(b) by 167 days.

(21) Appl. No.: 12/423,192

(22) Filed: Apr. 14, 2009

(65) Prior Publication Data

US 2012/0011757 A1 Jan. 19, 2012

Related U.S. Application Data

(60) Provisional application No. 61/044,637, filed on Apr. 14, 2008.

(51) Int. Cl.
*F41A 21/40* (2006.01)

(52) U.S. Cl. ..... 42/79; 89/14.2; 89/14.3; 89/14.4; 89/14.6

(58) Field of Classification Search ..... 42/79; 89/14.05, 89/14.2–14.6; 181/223
See application file for complete search history.

(56) References Cited

U.S. PATENT DOCUMENTS

| | | | | |
|---|---|---|---|---|
| 2,348,114 | A | 5/1944 | Dow | |
| 3,797,155 | A * | 3/1974 | Smith et al. | 42/79 |
| 3,812,610 | A * | 5/1974 | Kranz | 42/79 |
| 3,831,306 | A * | 8/1974 | Gregg | 42/79 |
| 3,867,778 | A * | 2/1975 | Preda et al. | 42/79 |
| 4,071,971 | A * | 2/1978 | Tornas | 42/79 |
| 5,317,825 | A | 6/1994 | Vatterott et al. | |
| 5,415,073 | A * | 5/1995 | Ciluffo | 89/14.3 |
| 5,452,535 | A * | 9/1995 | See et al. | 42/79 |
| 5,509,345 | A | 4/1996 | Cyktich | |
| 6,112,447 | A * | 9/2000 | Androsov | 42/79 |
| 6,557,290 | B2 * | 5/2003 | Kumler | 42/79 |
| 6,609,324 | B1 * | 8/2003 | Truitt, Jr. | 42/79 |
| 7,523,581 | B1 * | 4/2009 | Leutenegger et al. | 42/79 |
| 2005/0011102 | A1 | 1/2005 | Boyer | |
| 2008/0173166 | A1 * | 7/2008 | Andry | 89/14.3 |

* cited by examiner

*Primary Examiner* — Michael David
(74) *Attorney, Agent, or Firm* — Roetzel & Andress

(57) ABSTRACT

A shotgun gas exchanger comprising a gas exchanger tube for connectively engaging with a shotgun barrel and a choke disposed in the gas exchanger having longitudinal axial channels on the exterior surface thereof, such that gas from the shotgun barrel flows through the longitudinal axial channels and gathers in front of the muzzle end of the choke to retard the release of pellets from a wadding cup exiting the muzzle.

5 Claims, 4 Drawing Sheets

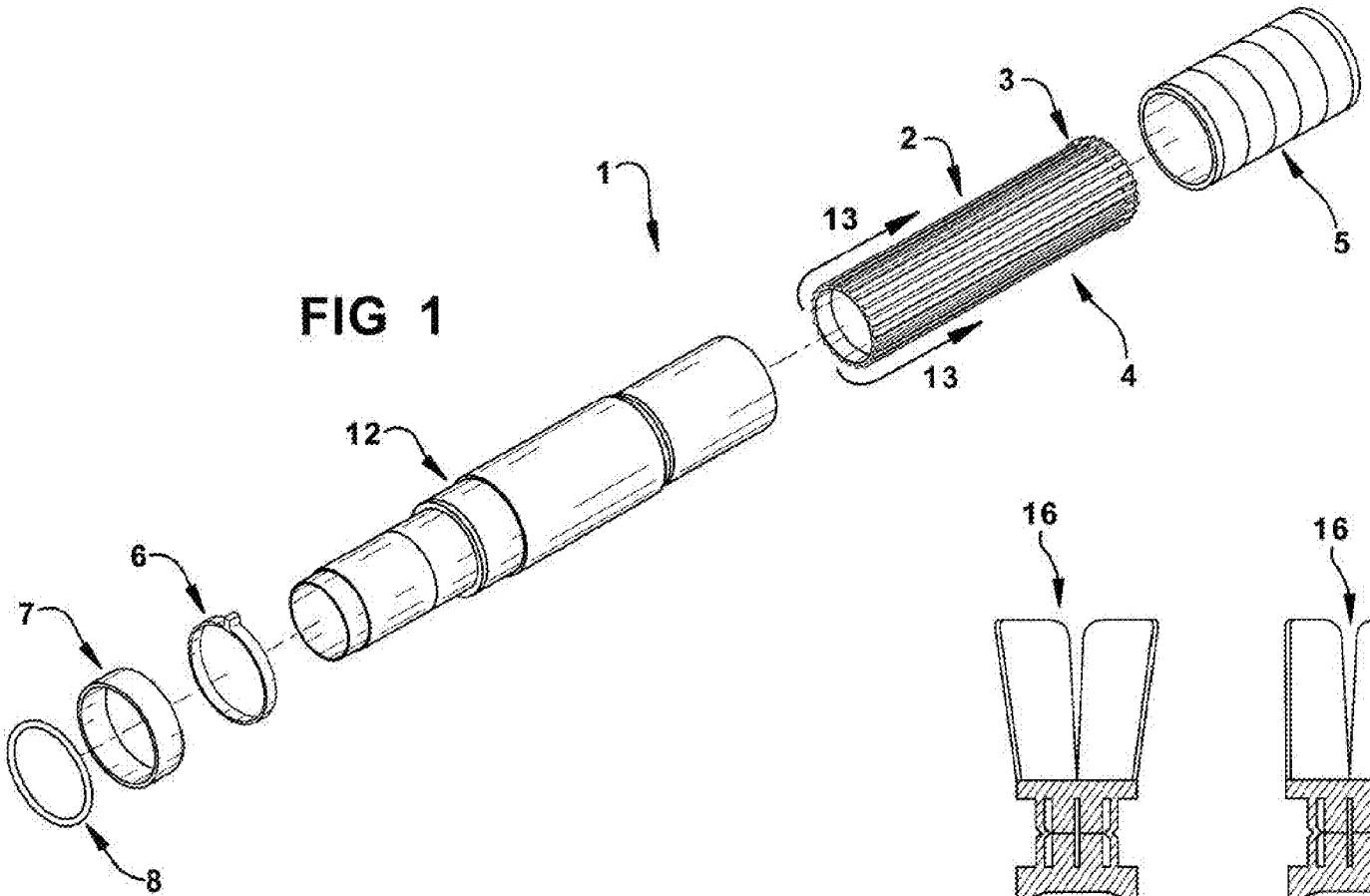
FIG 1
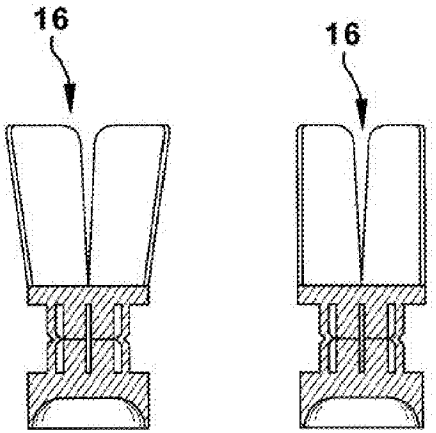
FIG 2A
FIG 2B

SHOTGUN GAS EXCHANGER

RELATED APPLICATION

This patent application claims the benefit and priority of U.S. provisional application 61/044,637, filed Apr. 14, 2008 for SHOTGUN GAS EXCHANGER, which is incorporated by reference in its entirety.

FIELD OF INVENTION

The invention relates to a gas exchanger apparatus for use with a shot gun. More specifically, the invention provides a gas exchanger, including a choke having at least interior and exterior axial channels and off-set wad-shaping alternating internal steps to enhance shotgun pattern and performance.

BACKGROUND OF THE INVENTION

Choke devices for use with shotguns are well known. The choke, when coupled to the barrel end of the shotgun, serves one of several purposes. It may restrict the shot pattern, or may result in a more disperse shot pattern, depending on the construction of the choke. Restricting shot pattern is generally achieved by decreasing the inner diameter of the choke approaching the muzzle end. It is known in this regard to use a series of annular steps to decrease the internal diameter of the choke. The decrease in diameter causes the shot to remain tightly compacted for a longer period of time, resulting in a tighter shot pattern. Conversely, by increasing the internal choke diameter approaching the muzzle, a more disperse shot pattern can be achieved. The actual degree of dispersion or restriction is determined by the shooter according to type of firearm and target being attempted.

Most often, the choke is used to restrict shot pattern. While annular grooves accomplish this to some degree, there remains a need for still further improvement. In addition, the wadding in which the shot is encased affects shot dispersion. As the wadding travels through the shotgun barrel toward the muzzle, including through an attached choke, the friction of the wadding on the muzzle interior slows the progress of the encased shot. It is known to use the decreasing diameter of annular grooves to retard the wadding in an attempt to release the shot more quickly. While the annular steps address the issue to some extent, there remains room for improvement.

An additional shotgun feature that affects gun performance is the build up of gas pressure behind the wad. It is this pressure that forces the wad through and out of the gun's barrel. However, it has been thought that this pressure can work against the desire to release the wad in such a manner that the shot pattern achieved is tight. This problem has been addressed thus far by providing apertures in the choke, or other means to expel the gas and pressure from the barrel of the gun and the choke mechanism. With devices such as these, the gas is released to the external environment surrounding the barrel, allowing the wad to proceed to the muzzle without experiencing further impact on the wad's compressed or uncompressed state.

Even with the addition of annular grooves and apertures to the choke mechanism, there remains a need for a device that further restricts or confines the shot pattern produced by a shotgun, particularly among those who target shot competitively, as well as among hunters in general.

SUMMARY OF THE INVENTION

The invention relates to a shotgun gas exchanger comprising a gas exchanger tube for connectively engaging with a shotgun barrel and a choke disposed in the gas exchanger having longitudinal axial channels on the exterior surface thereof, such that gas from the shotgun barrel flows through the longitudinal axial channels and gathers in front of the muzzle end of the choke to retard the release of pellets from a wadding cup exiting the muzzle. The invention further relates to a shotgun gas exchanger comprising a gas exchanger tube for connectively engaging with a shotgun barrel and a choke disposed therein and having at least one pair of off-set alternating wad-shaping steps on the interior surface thereof, the steps capable of forcing a leading edge of a wad passing through the choke to compress. The invention still further relates to a process for retarding the release of pellets from a shotgun wadding to enhance the tightness of the shot pattern created thereby using the foregoing gas exchanger.

More specifically, in one embodiment the present invention provides a shotgun gas exchanger comprising a gas exchanger tube for connectively engaging with a shotgun barrel and a choke having longitudinal axial channels on the exterior surface thereof, wherein the choke is received in the gas exchanger tube at the muzzle end thereof and gas from the shotgun barrel flows through the longitudinal axial channels and gathers in front of the muzzle end of the choke.

In another embodiment the present invention provides a shotgun gas exchanger comprising a gas exchanger tube for connectively engaging with a shotgun barrel and a choke having longitudinal axial channels on the exterior surface thereof, wherein the choke is received in the gas exchanger tube at the muzzle end thereof and gas from the shotgun barrel flows through the longitudinal axial channels and gathers in front of the muzzle end of the choke, and wherein the choke further includes longitudinal axial channels on the interior surface thereof.

In yet another embodiment the present invention provides a shotgun gas exchanger comprising a gas exchanger tube for connectively engaging with a shotgun barrel and a choke having at least one pair of off-set alternating wad-shaping steps on the interior surface of the choke, the steps capable of forcing a leading edge of a wad passing through the choke to compress.

In still another embodiment the present invention provides a shotgun gas exchanger comprising a gas exchanger tube for connectively engaging with a shotgun barrel and a choke having at least one pair of off-set alternating wad-shaping steps on the interior surface of the choke, the steps capable of forcing a leading edge of a wad passing through the choke to compress, and the choke further having longitudinal axial channels on the exterior surface thereof, such that gas flowing into the choke contacts and flows through the longitudinal axial channels and gathers in front of the muzzle end of the choke.

In a still further embodiment the present invention provides a process for retarding the release of pellets from a shotgun wadding to enhance the tightness of the shot pattern created thereby by compressing the leading edge of the shotgun wadding, the process comprising: a) providing a shotgun; b) providing a gas exchanger having a barrel insert engageable with a shotgun barrel; c) providing a choke tube disposed in the interior of the gas exchanger at the muzzle end thereof, and having multiple longitudinal axial channels circumferentially spaced on the exterior surface of the choke tube; d) firing the shotgun to force the shotgun wadding toward the muzzle of the shotgun barrel, wherein gas released upon firing the gun follows the wadding through the shotgun into the gas exchanger tube; e) the gas accessing the longitudinal channels on the exterior surface of the choke disposed in the gas exchanger and flowing over the length of the exterior of the choke tube following the channels until it reaches the muzzle; f) the gas flowing through the channels creating a pocket of gas in front of the muzzle as it reaches the muzzle such that the wadding, upon exiting the muzzle remains compressed until the wadding passes through the pocket and contacts air; and g) leading edges of the wadding flairing upon contact with air as the wadding passes through the pocket to release the pellets.

These and other embodiments of the present invention are fully set forth in the disclosure which follows.

BRIEF DESCRIPTION OF THE DRAWINGS

The Figures represent certain aspects of the claimed invention. Other aspects, variations and alterations will become apparent from a reading of the disclosure, in conjunction with the Figures, which are in no way intended to limit the over-all teaching herein.

FIG. 1 is an exploded view of a shotgun gas exchanger tube according to the invention.

FIGS. 2*a-b* are diagrams of shotgun wadding in the uncompressed and compressed state, respectively, according to the invention.

DETAILED DESCRIPTION OF THE INVENTION

Figure 3:
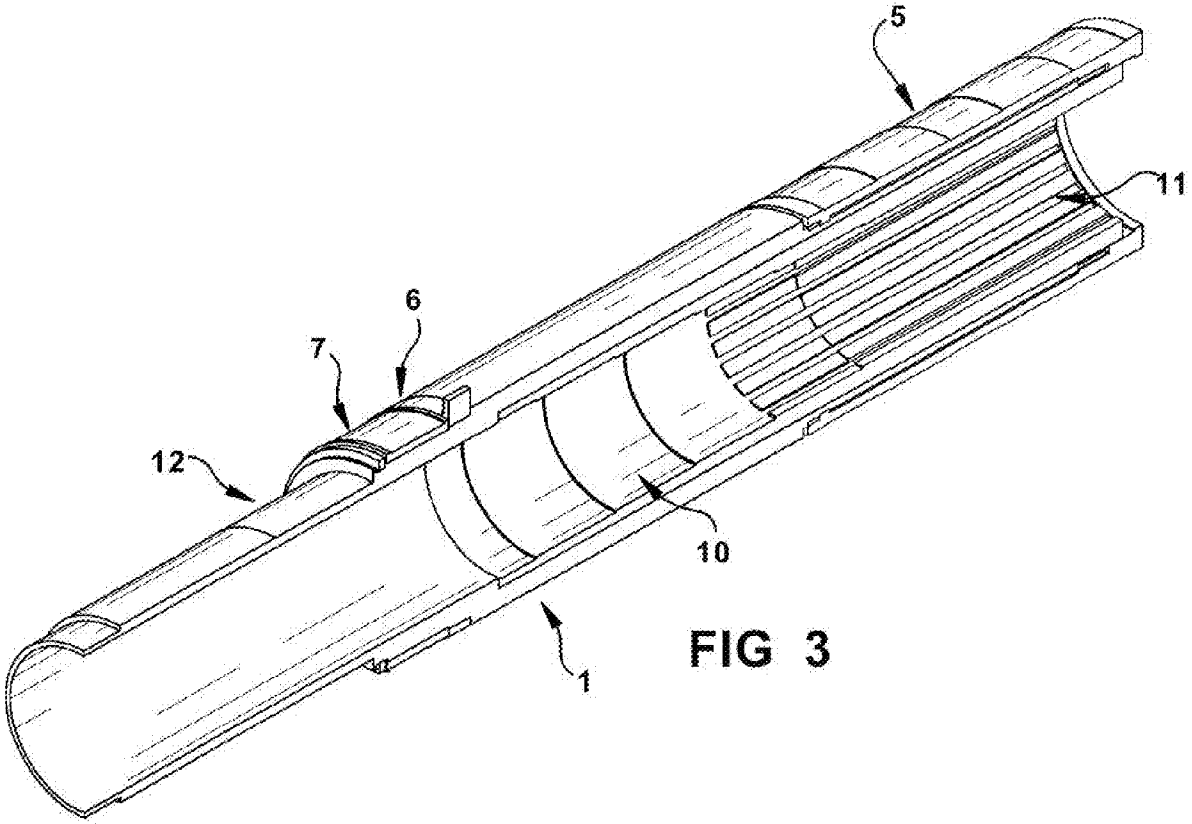
FIG. 3 is an axial cross-sectional view of an assembled shotgun gas exchanger tube according to the invention.

The invention provides a shotgun gas exchanger, including a choke capable of compressing the leading edge of wadding cup used to retain the shot pellets, also sometimes referred to as BBs. By the term "leading edge" is meant that end of the wad or wadding cup that leaves the muzzle first upon firing of a shotgun. The term "muzzle" indicates that opening in the shotgun or choke from which the shot is expelled.

With reference to FIG. 1, there is provided an exploded axial view of a shotgun gas exchanger 1 according to the invention. "Gas exchanger" is used herein refers to a mechanism capable of transferring gas and the pressure associated therewith from its position of trailing the wad as the wad enters the choke to a position in front of or leading the wad as the wad exits the choke. In this regard, the exchanged gas gathers at the muzzle end of the choke, creating a pocket of gas and replacing the air. This pocket of gas will eventually dissipate as it mixes with the air. Simultaneously with this dissipation, the wad, upon exiting the choke, will passes through the gas. The device, therefore, operates to exchange the position of the gas from behind the wad to in front of or leading the wad as it exits the muzzle end of the gun barrel, and has also exchanged or replaced the air directly in front of the muzzle and through which the wad passes.

In one embodiment of the invention, the shotgun gas exchanger 1 includes a body 12 and a choke or choke tube 2 which is axially received within the body 12. The terms "choke" and "choke tube" may be used interchangeably hereafter. The body 12 is configured to be axially engaged with the muzzle end or shot releasing end of the shotgun barrel (not shown). This may be accomplished in any conventional manner, including but not limited to, the use of threads that engage threading on the shotgun barrel, or other means, holding the gas exchanger 1 in place when engaged with the shotgun barrel. In addition, the choke 2 allows gas, generated within the shotgun barrel upon firing the shotgun, to escape toward the muzzle end of the choke, i.e. the end of the choke 2 which is oriented away from the muzzle of the gun barrel, opposite the end of the body 12 which is engaged with the gun barrel muzzle. This gas flow directed by the choke 2 forces the wadding 16 (or "wad") from a shotgun shell, shown in FIGS. 2, 8 and 9, axially down the shotgun barrel toward the muzzle. As the wad enters the gas exchanger 1 from the shotgun muzzle, it travels through the inner bore of choke 2. The gas from the explosion of the shotgun shell expands behind the wad 16, forcing it through the shotgun barrel and through the bore of choke 2.

In one embodiment of the present invention, as the wad enters choke 2, a portion of the gas following the wad is directed into external channels 4 that run longitudinally along the exterior surface of choke 2. Therefore, once the wad has completely entered choke 2 the gas, which has built up behind the wad, is divided between that which flows over the exterior surface of choke 2 through exterior channels 4, along the path of arrows 13, and the remaining gas which continues to flow through the choke 2 behind the wad. In this regard, it is important that exterior channels 4 are not too deep or they will relieve or bypass too much gas pressure, by allowing too much of the gas to flow over the exterior of choke 2 resulting in early flair of the wad petals and release of the shot, which will result in a more dispersed shot pattern. External channels 4 may have any suitable configuration, i.e., they may be squared, scalloped, V-shaped, or any other shape, so long as the channels are capable of funneling gas flow, and preferably an optimal amount of gas, over the external surface of choke 2 toward the muzzle end thereof.

Gas which is allowed to flow over the exterior of the choke and through exterior channels 4 reaches the muzzle of the gas exchanger ahead of the wad, which has been slowed to some degree by a decrease in the inner diameter of choke 2 relative to the bore of the gun barrel. In a preferred embodiment, the inner diameter of choke 2 becomes progressively smaller from the back end thereof toward the muzzle/exit end. This exterior flow of gas, channeled to the muzzle through exterior channels 4, creates an area in front of the muzzle and ahead of the exiting wad where the air is replaced by the gas. This reduction in the air contact on the leading edge 18 of the wad results in the wad remaining closed or compressed, as shown in FIG. 2B, for a longer period of time than would otherwise be experienced. The longer period of time that the wad remains in the closed or un-expanded condition shown in FIG. 2B after leaving the choke 2, the tighter the shot pattern will be.

Figure 4:
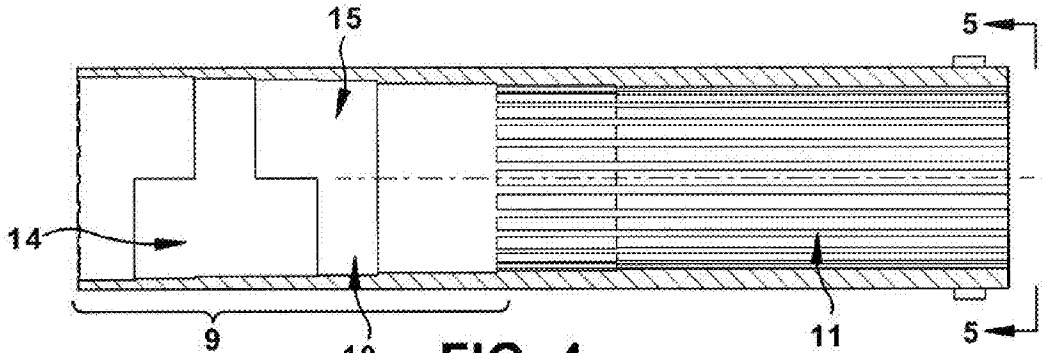
FIG. 4 is an axial schematic diagram of a shotgun choke according to the invention.
Figure 7:
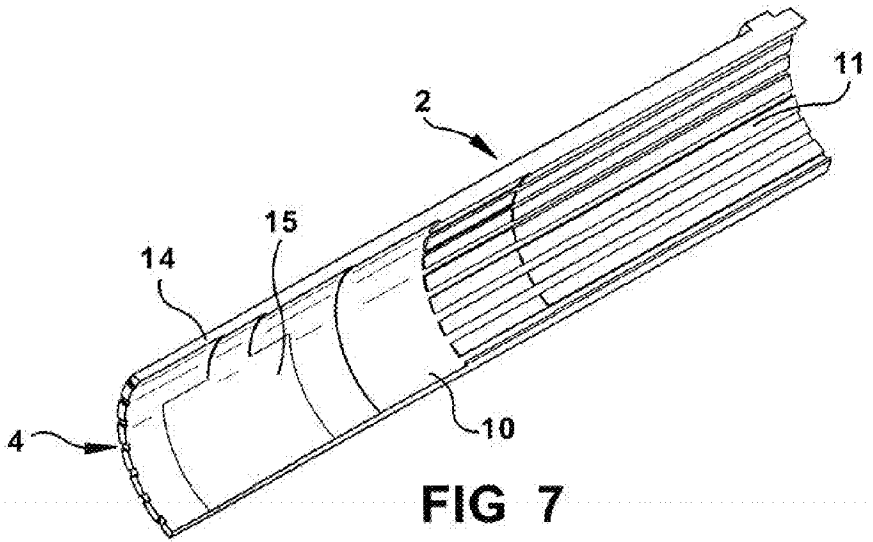
FIG. 7 is an axial cross-sectional view of a choke according to the invention.

As shown in various aspects of the Figures, and particularly FIGS. 4 and 7, according to one embodiment of the invention, the interior surface of choke 2 includes at least two sets of off-set areas in the general form of alternating wad-shaping steps 14/15. Because FIGS. 4 and 7 are cut-away or cross-sectional views, only one wad shaping step of each pair is shown. Each set of wad-shaping steps includes two steps, generally opposed to one another on the internal surface of choke 2. In this regard, if one were to divide the internal diameter of choke 2 into quadrants, numbered 1-4 moving clockwise around the inner diameter of the choke 2, the first set of wad-shaping steps may be positioned in quadrants 1 and 3, with the second set of wad-shaping steps 15 being positioned in quadrants 2 and 4, and just beyond wad-shaping steps 14 along the choke. Therefore, with this configuration of wad-shaping steps 14/15, upon entering choke 2 a wad first encounters wad-shaping steps 14 and then subsequently encounters wad-shaping steps 15. The wad-shaping steps are, in one embodiment, generally T-shaped and are raised from the internal surface of the choke. Due to this construction, as the leading edge 18 of the wad 16 encounters wad-shaping steps 14, the leading edges thereof that encounter the steps are forced to close down or compress, resulting in opposite sections of the leading edge of the wad being compressed. As the wad continues through the choke, the remaining leading edge sections of the wad encounter off-set, wad-shaping steps 15, which cause the remaining leading edge sections to be compressed, such that the entire leading edge is then closed down or compressed or bent inward, as represented in FIG. 2B. This compressed state of the leading edge of the wad aids in retention of the BBs or pellets within the wad for a longer period of time.

Figure 5:
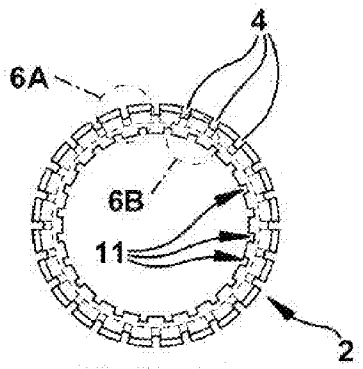
FIG. 5 is a radial schematic diagram along line A-A of FIG. 4 of a shotgun choke barrel according to the invention.

In another embodiment of the invention, and with reference several of the Figures, choke tube 2 further includes multiple axial internal channels 11. Internal channels 11 create a dentate pattern on the interior diameter of choke 2 as seen in FIG. 5 showing a cross section of the diameter of choke 2. In this embodiment the number of internal channels 11 is equal to the number of external channels 4, and channels 4 and 11 are equally spaced around the circumference or diameter of the choke. It is noted, however, that the number of internal and external channels need not be the same. Internal channels 11 function to score the outside surface of the wad as it passed through choke 2. Scoring the wad petals enhances the rigid nature thereof such that upon exiting the choke muzzle and proceeding through the gas pocket the opening thereof is retarded to retain the BBs or pellets for a longer period of time, allowing the wad to travel closer to the target, before the petals flair, releasing the BBs or pellets. This also contributes to and results in a tighter shot pattern.

In another aspect of the invention, provides a cap 5 that fits over the muzzle end of the choke and locks or secures choke tube 2 within gas exchanger 1. This cap may, in yet another aspect, be textured to enhance the ability of the user to more tightly grip the choke. In addition to the foregoing, cap 5 helps to further funnel the gas flowing through exterior channels 4 to the area exterior to and in front of the muzzle, creating a pressure pocket that forces air out of the way and envelopes the leading edge of the wad as it exits the muzzle. As is noted above, once the gas dissipates, the wad comes in contact with the air, the force of which causes the wad petals to flair and release the BBs or pellets.

In still another aspect of the invention, gas exchanger 1 may optionally include a ring site 6, and still further a ring site lock 7. While FIGS. 1 and 3 show the ring site 6 and ring site lock 7 positioned toward the back end of gas exchanger 1 where it connectively engages the shotgun barrel, this placement may be altered to the users preference. In use, and with reference to FIGS. 1 and 3, the ring site 6 slides over the exterior of gas exchanger 1 and is positioned to aid the shooter in lining up a target. Once positioned, the ring site lock 7 is used to secure the ring site 6 in the chosen position. Also shown in FIGS. 1 and 3 is retainer ring 8, which functions to keep the ring site lock from backing off and interfering with the gun barrel and properly seats the gas exchanger 1 to the muzzle end of the shotgun barrel.

FIG. 4 schematically shows yet another aspect of the choke 2 according to the invention. In this FIG. 4, interior axial surface 10 of choke 2 is shown to exhibit a decreasing diameter 9 as it progresses toward the muzzle end thereof. This decrease in diameter may be accomplished in several ways. The interior may be annularly stepped or the interior surface may be gradually tapered. The degree of taper shown in this FIG. 4 is merely representative and not intended to be limiting, as the distance and degree of tapering may be altered to shotgun and user specifications. As is shown in this FIG. 4, the assembled gas exchanger 1 may have in one particular embodiment an over-all length of 3.250 inches, and an internal diameter, decreasing from back to muzzle or front end of representative dimensions of about 0.73 inches to about 0.65 inches. Of course, these measurements are provided merely as an example, and would in use be determined by the shotgun dimensions and user preference.

Figure 6B:
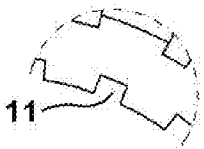
FIGS. 6*a-b* are diagrams of the exterior and interior protrusions/indentations of a shotgun choke according to the invention.
Figure 6A:
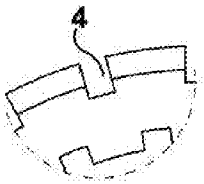

FIG. 5 illustrates the generally dentate-like pattern created by both exterior channels 4 and interior channels 11. The number and placement of the exterior channels 4 and interior channels 11 may vary. In one representative embodiment, the channels 4 and 11 range in number from 8 to 24, though fewer or greater may be used. Additionally, while channels 4 and 11 are generally equally circumferentially spaced, such spacing is not required. FIGS. 6A and 6B provide detail for exterior channels 4 and interior channels 11, respectively, according to one embodiment of the present invention. Additionally, the number of interior and exterior channels need not be the same, though in one embodiment they are equal in number. Still further, while the axial length of the exterior channels 4 should equal the length of the choke tube 2, interior channels 11 should extend only toward the back end of choke tube 2 far enough to meet off-set alternating wad-shaping steps 14/15. As has been noted above with regard to external channels 4 and equally applicable to interior channels 11, the channels may have any suitable configuration, i.e., they may be squared, scalloped, v-cut, or any other suitable shape.

Figure 9:
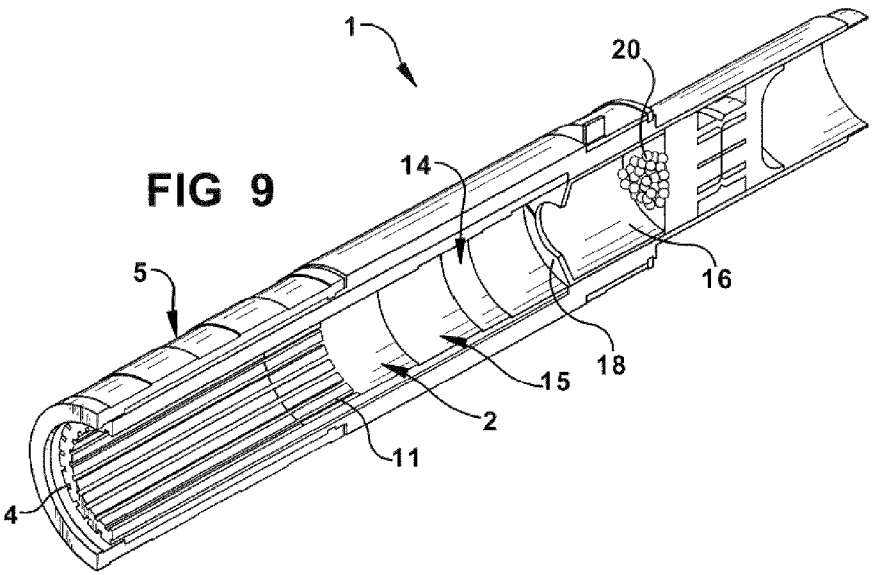
FIG. 9 is an axial cross-sectional view of an assembled gas exchanger according to the invention, showing wad having entered the gas exchanger.
Figure 8:
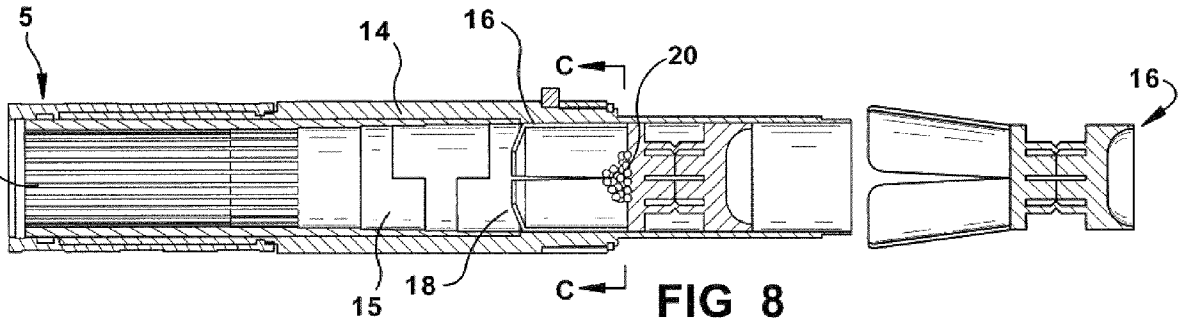
FIG. 8 is an axial cross-sectional view of an assembled gas exchanger according to the invention, showing wad before entering the gas exchanger.
Figure 10:
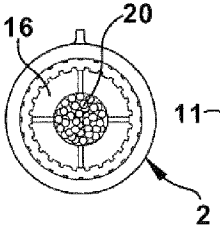
FIG. 10 is a diagram of a cross section of the gas exchanger according to FIG. 8 along line C-C thereof.

FIGS. 8 and 9 provide two perspectives of wad 16 within choke 2. As is seen, the leading edge 18 of wad 16 is in the closed or compressed state, having encountered at least one set of wad-shaping steps 14/15. Though the compression of wad 16 leading edge 18 preferably happens in successive steps upon the wad encountering first one set of steps 14 and then another step of steps 15, in the alternative, the entire circumference of wad 16 leading edge 18 may be compressed simultaneously with alternative positioning of the wad-shaping steps. FIG. 10 is a cross section of choke 2 along line C-C of FIG. 8, showing wad 16 and BBs or pellets 20 contained therein.

The invention has been described herein with respect to various aspects thereof. One skilled in the art, upon reading this disclosure and seeing the Figures will understand various, alterations and applications of the disclosure which are intended to be covered by the claims. The figures and embodiments presented herein are intended to aid the reader in fully understanding the disclosure, and are in no way intend to limit the full breadth of the invention represented thereby.

What is claimed is:

1. A shotgun gas exchanger comprising:

a gas exchanger tube for connectively engaging with a shotgun barrel; and a choke tube having longitudinal axial channels on the exterior surface thereof, the longitudinal axial channels extending an entire length of the choke tube;

wherein the choke tube is received in the gas exchanger tube at a muzzle end thereof so that gas from the shotgun barrel is directed by the choke tube to flow through the longitudinal axial channels of the choke tube and accumulates proximate to the muzzle end of the choke tube; wherein the choke tube further includes multiple longitudinal axial channels on the interior surface thereof; and wherein the number of longitudinal axial channels on the interior surface of the choke tube substantially equals the number of longitudinal axial channels on the exterior surface of the choke tube.

2. The shotgun gas exchanger of claim 1 further including a decreasing interior diameter progressing toward the muzzle end of the choke tube.

3. The shotgun gas exchanger of claim 1 further comprising a cap which engages with the muzzle end of the gas exchanger tube and retains the choke tube within the gas exchanger tube.

4. A shotgun gas exchanger for retarding the release of pellets from a shotgun shell to alter a shot pattern of the shotgun shell, the shotgun gas exchanger comprising: a body configured for engagement with an end of a shotgun barrel;

a choke tube disposed in the interior of the body, the choke tube having multiple longitudinal axial channels circumferentially spaced on an exterior surface of the choke tube and extending an entire length of the choke tube to direct gas from firing of the shotgun shell over an entire length of the exterior of the choke tube, and multiple internal longitudinal axial channels circumferentially spaced around an interior of the choke tube; and wherein the number of internal longitudinal axial channels substantially equals the number of longitudinal axial channels on the exterior surface of the choke tube.

5. The shotgun gas exchanger of claim 4 further comprising a cap which engages with a muzzle end of the body and retains the choke tube within the body.

* * * * *